United States Patent [19]

McDevitt

[11] 4,136,785

[45] Jan. 30, 1979

[54] MARINE CARGO STOWAGE RACK

[75] Inventor: Jerome A. McDevitt, El Toro, Calif.

[73] Assignee: Waco Scaffold & Shoring Company, Arlington Hts., Ill.

[21] Appl. No.: 830,883

[22] Filed: Sep. 6, 1977

[51] Int. Cl.[2] ..... A47F 7/00; E04G 1/06

[52] U.S. Cl. ..... 211/190; 52/638; 182/178

[58] Field of Search ..... 211/13, 182, 183, 184, 211/181, 189, 190, 191, 192, 194, 186–188; 52/633, 637, 638, 645, 646, 648, 650, 655, 721, 726; 182/178, 179

[56] References Cited

U.S. PATENT DOCUMENTS

| | | | |
|---|---|---|---|
| 2,217,055 | 10/1940 | Jennens | 182/178 |
| 2,237,572 | 4/1941 | Manion | 182/178 |
| 3,095,070 | 6/1963 | McDonald | 182/178 X |
| 3,263,692 | 8/1966 | Quosti et al. | 211/182 X |
| 3,345,825 | 10/1967 | Parker | 182/179 X |
| 3,807,120 | 4/1974 | Viandon | 52/638 |
| 4,039,264 | 8/1977 | Sharp | 182/179 |

FOREIGN PATENT DOCUMENTS

| | | | |
|---|---|---|---|
| 526548 | 5/1955 | Italy | 182/178 |
| 629768 | 12/1961 | Italy | 182/178 |

*Primary Examiner*—Roy D. Frazier
*Assistant Examiner*—Terrell P. Lewis
*Attorney, Agent, or Firm*—Watson D. Harbaugh

[57] ABSTRACT

A portable, preadjustable, knockdown and storable rack construction and system for holds of cargo ships embodying a geometric relation and pin arrangement which can be progressively assembled or dismantled with great time saving by hand or crane, or both, without tools, while loading or unloading unitized cargo crates. All parts are engaged and maintain their assembled engagement under gravity, cargo weight and ship vibration.

7 Claims, 4 Drawing Figures

MARINE CARGO STOWAGE RACK

BACKGROUND OF THE INVENTION

The increasing use of crane handled large size unitized cargo crates up to 3m × 3m × 12m, and potentially larger, to package and ship complete assemblies of ready cut materials to protect them against pilfering, damage and losses, has presented many stowage problems that are profitably resolved by this invention, preparing and using an entire cargo space, and by increasing the port speed in the loading and unloading.

The present invention is an improvement in the cargo handling syndrome and involves not only the preparation for particular types of cargo but eliminates waste of cargo shoring. It also improves the ease and rapidity of loading and unloading cargo ships as well as the safety of the cargo and personnel handling or in charge of cargo, both in port and in transit. These and the minimization of possible damage to the ship are basic considerations of the invention. Other objects and advantages will become apparent from the description which follows.

More particularly, the safety of the ship, its personnel and cargo is greatly improved by a loading technique and arrangement in which the cargo, disposed in large crates, is stowed and supported on readily assembled tiers of a cargo rack which are progressively assembled and dismantled, without tools, during the loading and unloading process, by labor freed of any required contact with the crated articles that make up the cargo. Labor quickly handles the rack elements, which are within labor regulation weight limitations, while and during the time that the deck officers handle the cargo units to place them on or remove then from the rack, thereby substantially reducing the expenses of cargo handling operations as a part of the operating costs of a general cargo carrier.

The rack parts engage and disengage freely in a self guiding and aligning relation with relative vertical movement accomplished either by hand or crane, or both, They are loosely fit but snugly held in assembled relationship soleby by gravity and cargo weight distribution to provide for the rapid crane handling of cargo crates that may be tiered both horizontally and vertically in defined cubicles. Thus the cargo crates are weight supported and secured and independently of one another upon readily assembled preadjusted and interchangeable rack elements that provide knockdown reusable stowage racks which are quickly set up progressively during cargo loading and are readily dismantled progressively as part of the cargo unloading procedure. When dismantled the rack parts can be easily handled in compact bundles for stowage on the ship between uses leaving the holds clear for a different cargo on a return trip, or trips to other ports.

The preadjustable elements, when assembled and in use, serve as a firm part of the ship well within the seagoing requirements and maritime regulation for cargo ships relating particularly to loading, draft, stability and metacenter considerations.

More particularly with regard to the older cargo ships which have slow or limited speeds, the speed of loading and unloading in port, generally referred to as "port speed," in whatever order they occur, is highly desirable to increase the ships "productivity" competitively. The invention minimizes the desire for competitively increasing cargo ship running speeds which directly involves increased fuel consumption. The reciprocal saving in fuel and port speed is more desirable. It improves profits that are directly related to cargo revenue, and the need for extensive training of miscelllaeous labor in any port is greatly reduced. Pilfering and damage to cargo is minimized to that immediately detectable by viewable damage to a crate.

IN THE DRAWINGS

DESCRIPTION OF THE INVENTION

The invention involves the joint consideration of structure and procedures which will be described concurrently, namely, the novel rack construction, its ready assembly and dismantling by hand without tools, and its loading and unloading by crane in several different procedures.

Figure 1:
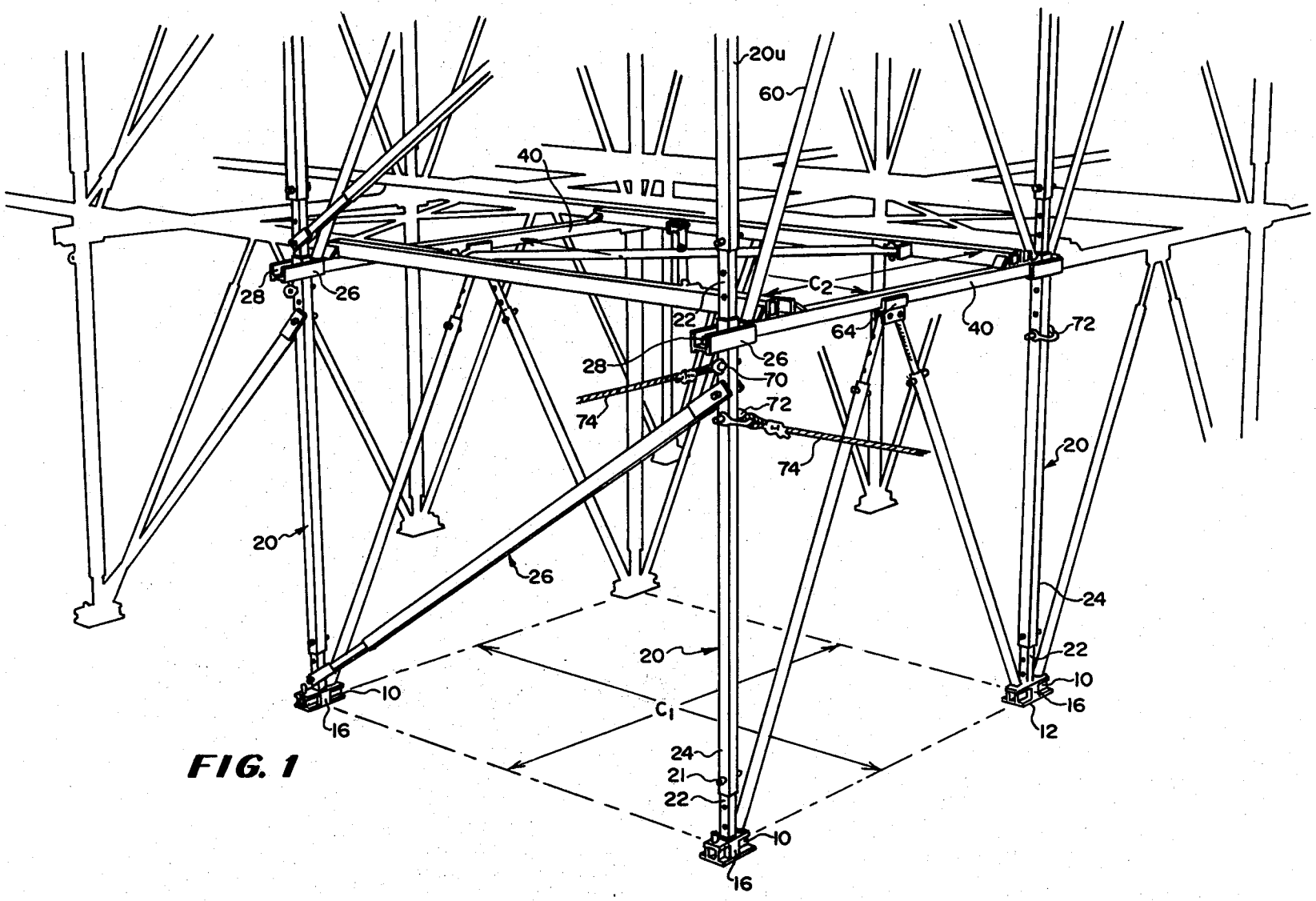
FIG. 1 is an isometric view of a portion of an assembled multiple tier rack in a ship's hold for crated cargo.

Once the deck D in a cargo ship's hold H (FIG. 3) is cleared and swept clean, base members (FIG. 4) are set thereon in a predetermined rectangular pattern 11 without slippage or damage to the deck. They have broad weight bearing bottoms 12 (FIG. 4) carrying vertical pins 14B located on opposite sides of a square upstanding ferrule 16 that is integrally secured thereto. The ferrule 16 defines a vertically directed large square opening 18 to receive and support the legs 20. Four of these properly set, and horizontally spaced base units 10 (FIG. 1) define a rectangular cubicle C for receiving a single cargo crate (not shown) upon the cargo deck D (FIG. 1).

All legs 20 are interchangeable. Each leg 20 comprises two adjustably extendable, non-rotatively telescoping tubular square members, 22 and 24, that are secured by a cross pin 21 in openings 23. The smaller members 22 extend downwardly beyond the larger tubular members 24 in vertical position and are receivable and non-rotatably supported vertically in the openings 18 of the ferrules 16. The upper ends of the large tubes 24 are of the same shape and size as the ferrules 16 to receive in turn small ends 22 of legs 20 disposed above them in axially supported relation.

A cross head 26, similar to a base member 10, is secured to the upper end of each of the large ends 24 of the legs 20 for duplicating for the next tier the significant structure and dimensions of the base member 10 with respect to the ferrule 16 but additionally has upwardly opening laterally extending troughs or channels 28 on opposite sides, each having an upstanding pin **14*u* in it. The two upper pins 14*u* are aligned with the base plate pins 14*b* and all serve the same purpose as steadying points of lateral securement and support of braces 60**, later described, as identified by the same numerals but different suffixes that are related to vertically spaced levels.

Figure 2:
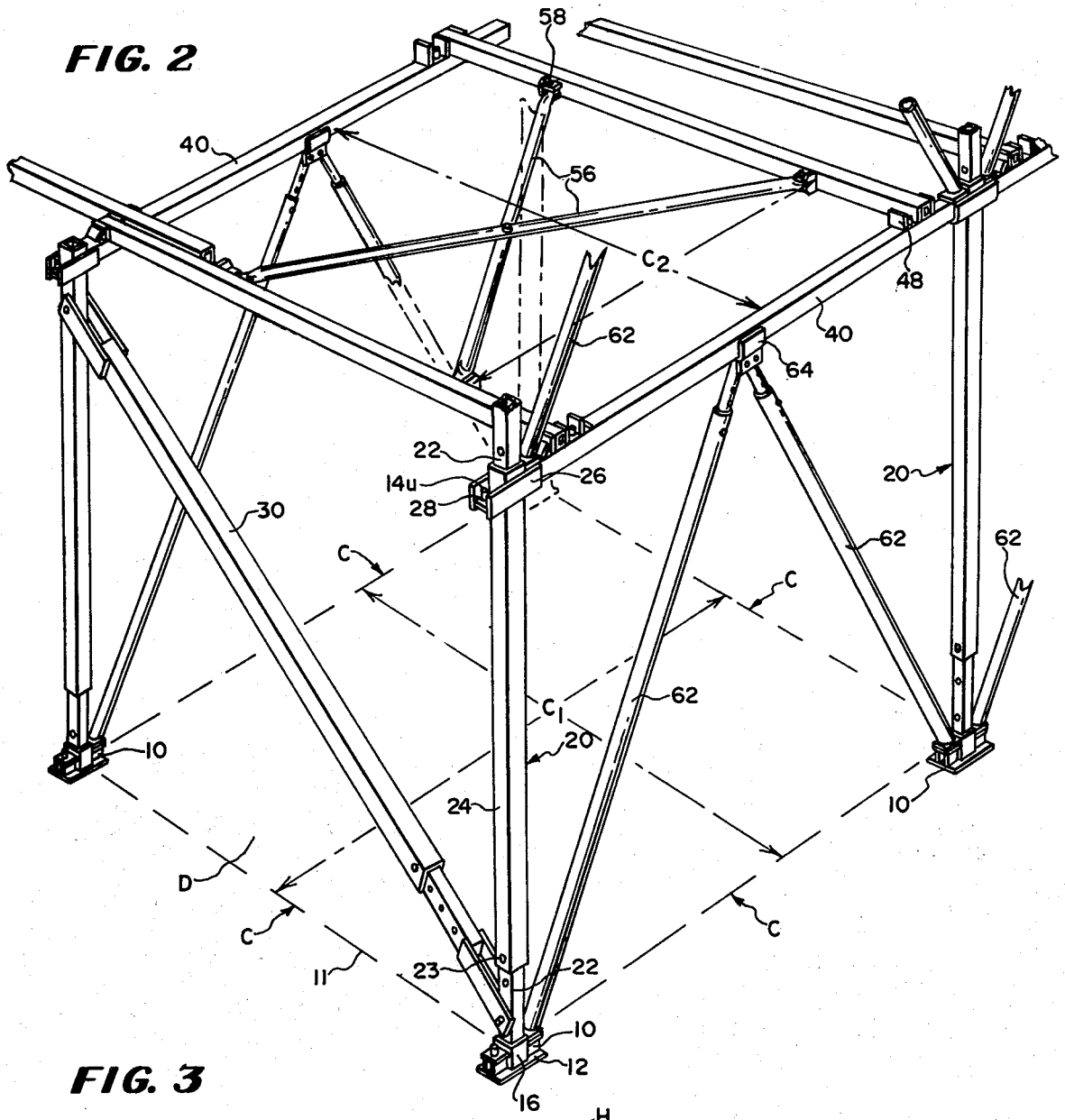
FIG. 2 is an isometric view illustrating in detail the elements involved with one cubicle of a rack embodying the invention.
Figure 3:
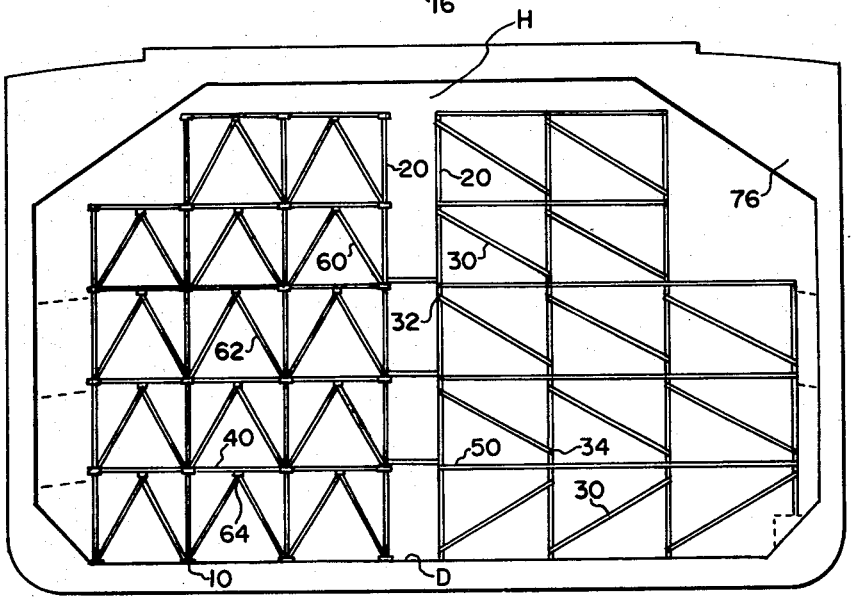
FIG. 3 is a composite elevational view of a rack set up in a ship's hold as it appears on two adjacent sides.
Figure 4:
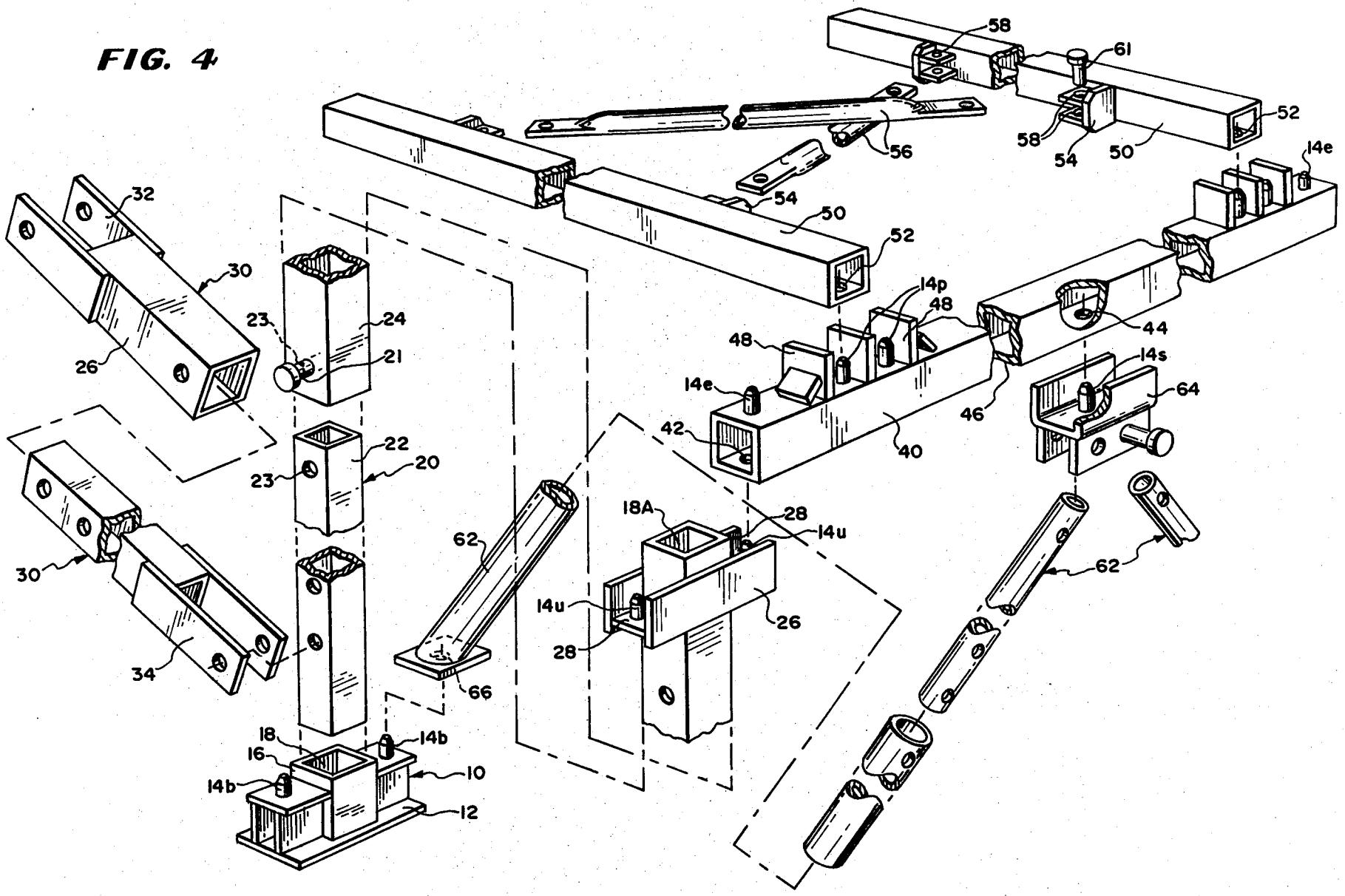
FIG. 4 is an exploded enlarged perspective view of the elements and their significant relation embodying the invention.

Groups of upstanding horizontally spaced legs **20*u* in the upper tiers have their smaller ends 22 received in the sockets 18A upon the upper ends of the next lower tier of legs 20** and define cubicles C2 in a second tier (FIG. 2). Third and fourth tiers can likewise be added both laterally and upwardly as indicated in FIG. 3

Telescoping pre-adjustable diagonally extendable side brace 30 having forklike ends 32 and 34 bridges two adjacent legs 20 (FIG. 1). At its larger end the brace 30 is pinned to the large portion 24 of one leg 20 and at its other end diagonally therefrom is pinned to the smaller telescoping member 22 of another leg. These braces are effective to maintain the legs upright in one plane and may be inclined in either direction, see FIG. 3.

Two girder members 40 are involved for each cubicle and have openings 42 and 44 in their lower side 46. There is one opening 42 adjacent each of their ends and the third opening 44 located at its midpoint. In assembly of the rack, their ends are placed in the guide throughs 28 and are moved endwise until the holes 42 drop over the pins 14*u*. Thus, the end openings 42 receive the pins 14*u* when lowered into place, and are held engaged at least by the weight of the girder.

On its upper side each girder 40 has upstanding pins 14*e* welded to it arranged in a row with end pins 14*e* functioning as extensions of pins 14*u*. Inwardly thereof pairs of pins 14*p* are disposed in side by side transverse saddles 48 adjacent each end, each having an upstanding pin 14*p* therein.

The vertical pins 14, as respectively identified, preferably constitute the sole connection means between the respective members described and are brought into nonslip engagement by relative vertical movement whereby they are secured in place by their own weight, and by the weight of any gravity load they bear. The troughs 28 and saddles 8 serve as guides for easy and fast assembly engagement of the respective pin and hole engagements as noted.

Two beam members 50 are provided which have holes 52 adjacent to their ends to receive the pins 14*p*, and spaced fixed ear brackets 54 on their facing sides having vertical holes 58 to receive apertured ends of "X" spreaders 56 secured by vertical pins 1 that hold them in predetermined spaced relation.

Inverted "V" side braces 62 are also provided. They not only support the center of the girders 40 above them by a saddle 64 and pin 14*s* engaging in the hole 44 but they plumb the legs 20 and square the girders 40 with respect to the pins 14*b* in the bases 10 when they are received in the foot holes 66 in the lower ends of the diagonal braces 62.

Holes 70 are provided in the legs 20 near their top (FIG. 1) to receive shackles 72 for guy-cable connections 74 to the ship's structure 76 (FIG. 3) for horizontal tension and loose joint clearance take-up after loading. They function also to strengthen and steady the hull and cargo as a unit.

CARGO STOWING OPERATIONS

Assuming that all parts preferably have been preadjusted, the bases are located on the hold deck. Two legs 20 are located in place where primary accessibility has been determined and a girder 40 has its ends lowered over the adjacent pins 14*u;* the lower end of each side brace 62 is lowered at its lower ends over the base pins 14*b* and the girder 40 raised enough for the hole 44 on its lower side to engage over the brace pin 14*s*. This can also be accomplished with the first set of legs laid flat on the deck, the associated parts assembled as noted and then the assembly raised to the upright position shown.

The opposite pair of legs 20 are likewise assembled, raised, and with both pairs of legs 20 disposed vertically, the beams 50 are lowered into place. Thus, the first cubicle of the first tier is erected and is squared to support and plumb additional legs to form adjacent cubicles. The crate (not shown) is set in the first cubicle before the beams 50 are set. Thereafter the beams 50 are lowered into place and the assembly advances to the next cubicle.

The cargo can be loaded and stowed in at least two different routines depending upon port equipment. Either the racks can be erected progressively and loaded by a crane, tier-by-tier through the hatch from the deck cargo upwardly, with or without fork lift truck assistance, or with a slight modification in the rack installation procedure, either installing all rack parts full height progressively across the deck in vertical full height sections where hatch width may present problems, or, tier-by-tier over the whole cargo deck area with each tier being loaded before the next higher tier is erected. The former assists fork lift truck loading, while the latter assists crane loading. This provides work flexibility for port conditions. In either case, the successive rack portions in a tier can be assembled in place while the loading proceeds.

Preferably, however, a modification of this last procedure is desirably attainable. The crates in the lowest tier are first set in place on the deck, where indicated by the base members 10 and with workmen on top of these crates, the first tier rack elements can be set easily around them all at one time in spaces as narrow as 4 inches wide. Then the beams are laid for supporting the second tier of crates. This is progressively repeated for each tier.

After the top beams 50 over the next-to-last tier of crates have been set, the last tier of crates can be disposed thereon and skidded into any position desired. Thus, once the first crate is positioned, a virtually continuous process is instituted of rack assembly and crate positioning that proceeds with time saving simultaneity and with the positioning of the last crate outdistancing the rack assemblying.

There is also an economy of parts and rack assembly time with this tier-by-tier arrangement. Once the first cubicle is assembled around the first crate, the next cubicle of that tier needs less time with only two legs to be added. When the third cubicle is placed side-by-side, only two legs are added, and with a fourth cubicle added to make a square only one leg need be added. Therefore, only nine legs are required for four cubicles which otherwise could require 16 legs. The girders perform double duty, only six being required instead of eight; however, two beams are required for the top of each cubicle and the top tier of crates can be positioned upon the last tier of beams thereon with no further rack building required around them. Thus, there is one less tier of rack than there are tiers of crates and "port speed" is greatly improved because labor can be finishing the last rack when the crane is ready to position the last couple of crates.

For instance, once the crates are being positioned, labor begins setting up the cubicle frame-work which progresses more rapidly with fewer rack parts being involved after the first two or three crates have been set. The crane continues setting crates of the first tier and starts on the second tier with at least half of the first tier rack finished. The rack building and crate setting times have coincided saving "port time." The simplicity of the "no tool" rack-building procedure can be computed to be fast enough to stay ahead of the setting of the last crate by local dock facilities of known capability. The unloading is the reverse of the loading routine.

Of substantial importance is the salvage and repeated reuse of the cargo rack, it being noted that return cargo very well may be quite different from out-bound cargo, and, in unloading, the rack has already been removed from the hold to accommodate the new cargo. The parts for each cubicle can be stored in separate bundles.

Inprovement of working conditions for everyone is provided, as well as eliminating the need of tools that might acdidentally be dropped or lost. Only those of the simplest concept and skill are used such as a mallet.

The different elements providing the racks are few in number, namely eight, and no small parts or screws are involved to get lost; and damaged part can be quickly replaced; no tools are required nor time lost looking for or using them. No parts of the rack weigh more than prescribed by labor regulation for two men to handle at a time; all parts engage and maintain their engagement under gravity and load without wedging.

Moreover, the rack structure and arrangement lends itself to resolving problems involved with cargo loading plans of the ship's master.

The use of the girders and beams that rest directly on the bases prevents free moisture contact with the cargo resting on them; the vertical spacing of the girders and beams on the legs eliminates condensation, load crushing package chafing and spontaneous heating or hygroscopoc moisture transfer occurring with some types of cargo.

Also the need for dunnage is eliminated with its replacement expense and its handling by labor. Damaged metal elements of the invention can be repaired and used again. Sweat battens for air circulation are not needed, nor tims, shores or braces.

The invention enhances well known principles of stowage involved with the protection of the ship, cargo, crew and longshoremen, maximum use of available cubic as well as rapid and systematic discharging and loading. Vertical weight distribution is a concern with ship stability involving the roll of the ship which might otherwise cause cargo shifting transversely or heavy wracking stresses on the hull. Longitudinal distribution of cargo involves equal distribution of cargo on both sides of the centerline as related to the ships roll as by raising the center of weight to give a stiff ship a comfortable roll which has many cargo advantages also.

What is claimed is:

1. A stowage rack for cargo carriers including a plurality of base members of substantial height each defining a vertically directed open socket and a plurality of first vertical pins supported in pairs adjacent to each socket and extending upwardly a short distance above a cargo deck around each socket, a plurality of vertical extendible legs having an extension member whose lower end telescopes with said open socket in supported relation and whose upper end includes, a support collar means having a socket of the same opening size and shape as said open socket and a laterally extending cross head portion parallel with said base below it having second vertical pins extending upwardly and aligned with said first vertical pins, girder means terminally having an opening received on one of said second vertical pins and defining crosswise channel sections adjacent thereto having vertical pins therein, beam members received in said crosswise channel sections having openings received on said last vertical pins, and side brace means interconnecting said girder means and one of the first vertical pins for maintaining said leg and girder at right angles to each other.

2. The combination defined in claim 1 including four of said legs supporting two of said girder means in parallel relation and two of said beam members spaced and supported at right angles to two of said girder means, and including another side brace means interconnecting another one of said second vertical pins of another one of the bases to maintain said legs in vertical orientation.

3. In a knock down scaffold for cargo having four vertical cross sectionally square legs with upwardly facing cross head channels extending laterally from two of their opposite sides in parallel relationship aligned in two parallel pairs and having upwardly extending pins in said channels, two parallel girders adapted at opposite ends to be received in said channels and engage said pins in pairs each having parallel cross saddle elements intermediate their ends with upwardly extending pins in each of them, and two parallel beams having ends engaging the latter pins in said cross saddle elements adjacent to their ends in weight holding relation.

4. A knockdown stowage rack for a cargo carrier having a freight deck for carrying several tiers of shipping crates, a plurality of spaced bases of appreciable height arranged on the deck defining cubicle areas for receiving individual crates, each defining one member of a vertically telescoping joint of predetermined size and having a pair of vertically extending pins each spaced from said one member a predetermined distance, a plurality of vertical legs each having at one end an element comprising the other member of each joint and at the other end a duplicate of said one member for a like joint and including a cross head channel member having another pair of vertically extending pins coaxially aligned with said first pins and horizontally arranged in two parallel lines with the cross channel members adjacent thereto, a pair of spaced horizontal girders each terminally having vertical openings received over pins of two of said other pairs of pins, and having pairs of horizontal crosswise channels adjacent to said pins with vertical pins in them, and a pair of spaced horizontal beams resting in said crosswise channels with openings receiving the last said vertical pins in weight borne relation to provide a second crate bearing cubicle above the first.

5. The stowage rack defined in claim 4 including a brace means interengaging the upper end of one of the legs and the lower end of an adjacent leg to maintain the legs in vertical position.

6. A knockdown stowage rack for a cargo carrier having a freight deck for carrying several tiers of shipping crates, a plurality of spaced bases of appreciable height arranged on the deck defining cubicle areas for receiving individual crates, each defining one member of a vertically telescoping joint of predetermined size and having a pair of vertically extending pins each spaced from said one member a predetermined distance, a plurality of vertical legs each having at one end an element comprising the other member of each joint and at the other end a duplicate of said one member for a like joint and including a cross head channel member having another pair of vertically extending pins coaxially aligned with said first pins and horizontally arranged in two parallel lines with the cross channel members adjacent thereto, a pair of spaced horizontal girders each terminally having vertical openings received over pins of said two of said other pairs of pins, and having pairs of crosswise channels adjacent to said pin with vertical pins in them, a pair of spaced horizontal beams resting in said crosswise channels with openings receiving the last said vertical pins in weight bourne relation to provide a second crate bearing cubicle above the first and, V-brace means having openings at their ends vertically received on vertically extending adjacent pins on adjacent bases and the V-brace having a vertical pin vertically engaging an opening on the lower face of the girder, in girder supporting relationship.

7. A knockdown stowage rack including four vertical legs each comprising vertically extendible telescoping members and including means for locking the two telescoping members in selected extended relation, four base members receiving the lower ends of the legs in position supporting relation, four crosshead channel members supported one on each of the upper ends of the legs, said base and channel members supporting vertically spaced and axially aligned pairs of upstanding pins disposed parallel with each leg, diagonal means interconnecting adjacent vertically spaced ends of legs to hold them parallel, girder means received vertically at opposite ends on said channel members having pairs of upstanding pins at one end of the legs, and beam means receivable upon the vertical girder means pins in parallel spaced relation for supporting cargo.

* * * * *